US008777769B2

(12) United States Patent
Pepe et al.

(10) Patent No.: US 8,777,769 B2
(45) Date of Patent: Jul. 15, 2014

(54) TEACHING AID FOR PROPERLY GRIPPING A GOLF CLUB AND METHOD OF USING THE SAME

(71) Applicants: William S. Pepe, Greenwich, CT (US); Gary Weir, Irvington, NY (US)

(72) Inventors: William S. Pepe, Greenwich, CT (US); Gary Weir, Irvington, NY (US)

(73) Assignee: P-WI Golf Innovations, LLC, Greenwick, CT (US)

( * ) Notice: Subject to any disclaimer, the term of this patent is extended or adjusted under 35 U.S.C. 154(b) by 0 days.

(21) Appl. No.: 13/958,844

(22) Filed: Aug. 5, 2013

(65) Prior Publication Data

US 2014/0038736 A1 Feb. 6, 2014

Related U.S. Application Data

(60) Provisional application No. 61/776,280, filed on Mar. 11, 2013, provisional application No. 61/679,975, filed on Aug. 6, 2012.

(51) Int. Cl.

| | |
|---|---|
| ***A63B 69/36*** | (2006.01) |
| ***A41D 19/00*** | (2006.01) |
| ***A63B 71/14*** | (2006.01) |

(52) U.S. Cl.

CPC ..... *A63B 69/3608* (2013.01); *A63B 71/146* (2013.01)

USPC ..... 473/205; 473/201; 2/161.2

(58) Field of Classification Search

CPC ..... A62B 69/3608; A63B 53/14

USPC ..... 473/201, 203, 204, 205, 206, 212, 226, 473/409, 450, 458; 2/160–161.4

See application file for complete search history.

(56) References Cited

U.S. PATENT DOCUMENTS

| | | | | |
|---|---|---|---|---|
| 3,532,344 | A | | 10/1970 | Masstab |
| 3,848,874 | A | * | 11/1974 | Elkins, Jr. ..... 473/409 |
| 5,232,225 | A | | 8/1993 | Snyder |
| 5,248,141 | A | * | 9/1993 | Kelly ..... 473/303 |
| 5,348,303 | A | * | 9/1994 | Swissheim ..... 473/201 |
| 5,542,126 | A | * | 8/1996 | Harvanek ..... 2/161.2 |
| 5,644,795 | A | | 7/1997 | Landis et al. |
| 5,704,065 | A | | 1/1998 | Feuerhake |
| 5,836,828 | A | | 11/1998 | Sinton |
| 5,855,022 | A | | 1/1999 | Storto |
| 6,272,686 | B1 | | 8/2001 | Liu |
| 6,363,535 | B1 | | 4/2002 | Landis |

(Continued)

FOREIGN PATENT DOCUMENTS

| | | |
|---|---|---|
| WO | WO 0224010 A2 | 3/2002 |
| WO | WO 2004105898 A1 | 12/2004 |

OTHER PUBLICATIONS

Golf Pride #1, Grip on Tour found at http://golfpride.com/grips/decade-multicompound/, printed on Feb. 22, 2013 (3 pgs).

*Primary Examiner* — Nini Legesse

(74) *Attorney, Agent, or Firm* — Hiscock & Barclay, LLP

(57) ABSTRACT

Disclosed in this specification is a golfing glove that is configured to facilitate the proper grip of a golf club handle and a method of using the same. The palmar surface of the glove comprises a first indicator that extends along its width. A second indicator also disposed on the palmar surface. The thumb of the glove has a third indicator. The dorsal surface of the glove has a first elongated indicator aligned with the thumb and a second elongated indicator on the dorsal surface.

9 Claims, 9 Drawing Sheets

(56) References Cited

U.S. PATENT DOCUMENTS 8,070,619 B2 12/2011 Edwards
2007/0184911 A1 8/2007 Pinkart
2009/0217441 A1 9/2009 McCree et al.
2011/0263346 A1 10/2011 Wise et al.

* cited by examiner

TEACHING AID FOR PROPERLY GRIPPING A GOLF CLUB AND METHOD OF USING THE SAME

CROSS-REFERENCE TO RELATED APPLICATIONS

This application claims priority to, and the benefit of, U.S. patent application Ser. No. 61/776,280 (filed Mar. 11, 2013) and U.S. Patent Application Ser. No. 61/679,975 (filed Aug. 6, 2012), the entirety of which are incorporated herein by reference.

FIELD OF THE INVENTION

This invention relates, in one embodiment, to a teaching aid for instructing students to properly grip a golf club and method of use for the teaching aid.

BACKGROUND

It is well recognized in the field of golf that a proper grip is essential for optimal performance. However, many individuals who wish to learn the sport struggle to develop a proper grip. Teaching aids have been developed to assist instructors when teaching new golfers but none of these teaching aids has proven entirely satisfactory. Additionally, many of these aids are prohibited for use during golfing tournaments.

Therefore, an improved teaching aid to promote the proper grip of a golf club is desired.

SUMMARY OF THE INVENTION

Disclosed in this specification is a golfing glove that is configured to facilitate the proper grip of a golf club handle and a method of using the same. The palmar surface of the glove comprises a first indicator that extends along its width. A second indicator also disposed on the palmar surface. The thumb of the glove has a third indicator. The dorsal surface of the glove has a first elongated indicator aligned with the thumb and a second elongated indicator on the dorsal surface.

In one exemplary embodiment, a method for gripping a golf club is disclosed. A method of gripping a golf club comprising the steps of providing a glove with a predetermined configuration and providing a golf club handle with another predetermined configuration. The glove and the golf club handle include indicators configured to align and mate.

In a second exemplary embodiment, a system for gripping a golf club is provided. The system includes a glove with a predetermined configuration and a golf club handle with another predetermined configuration. The glove and the golf club handle include indicators configured to align. In one embodiment, the glove and the golf club handle are packaged together as a kit.

In a third exemplary embodiment, a golf glove is provided. The golf glove comprises three adhesive indicators and two other indicators to facilitate the proper gripping of a golf club.

BRIEF DESCRIPTION OF THE DRAWINGS

The present invention is disclosed with reference to the accompanying drawings, wherein:

FIG. 5A illustrates the alignment of a fifth indicator with a second indicator while

Corresponding reference characters indicate corresponding parts throughout the several views. The examples set out herein illustrate several embodiments of the invention but should not be construed as limiting the scope of the invention in any manner.

DETAILED DESCRIPTION

Figure 1:
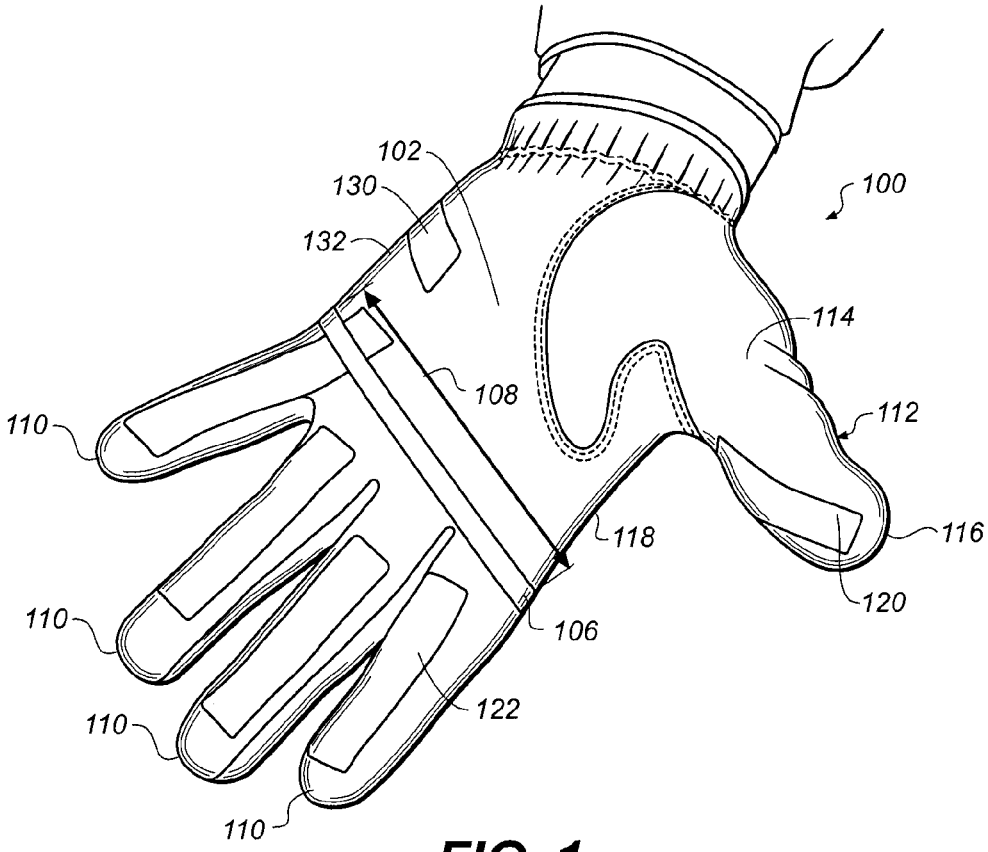
FIG. 1 is a depiction of an exemplary glove showing its palmar surface.
Figure 2B:
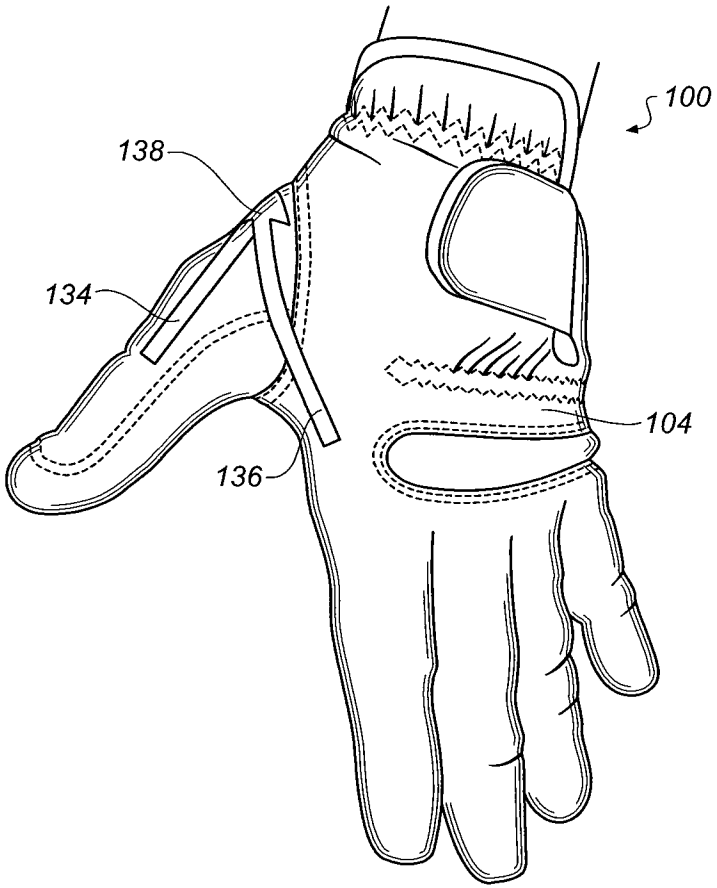
FIG. 2A and FIG. 2B are depictions of the exemplary glove showing its dorsal surface.
Figure 2A:
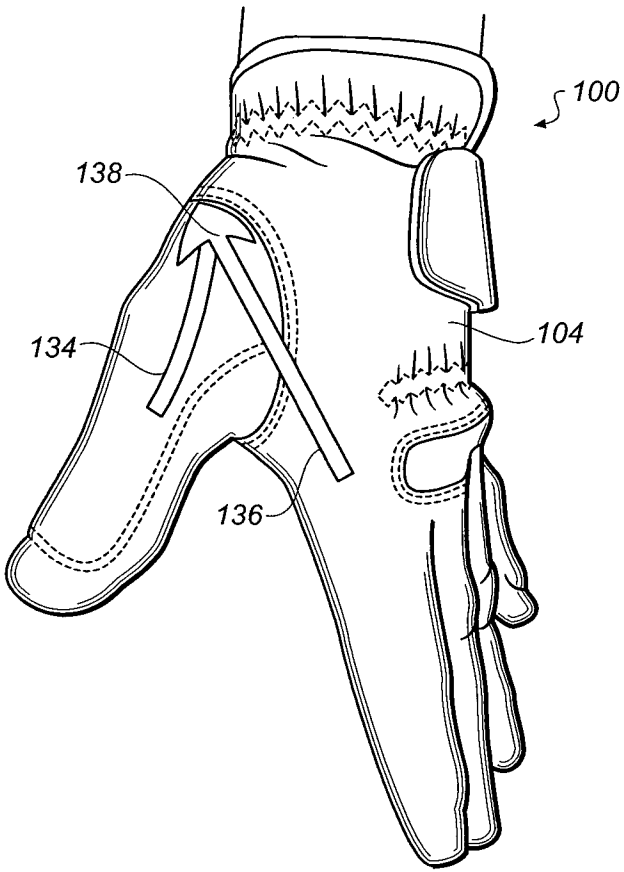

FIG. 1, FIG. 2A and FIG. 2B are depictions of an exemplary glove 100. The glove 100 may be formed of any suitably flexible material, including cloth. FIG. 1 depicts a palmar surface 102 while FIG. 2A and FIG. 2B depict a dorsal surface 104 of the glove 100.

As shown in FIG. 1, the palmar surface 102 of the glove 100 has an elongated first indicator 106 that is disposed proximate to finger receptacles 110. In one embodiment, one or more the finger receptacles 110 includes an additional indicator 122. The elongated first indicator 106 extends along width 108 of the palmar surface 102.

The palmar surface 102 also includes a second indicator 130 which is disposed along a second edge 132 of glove 100 over the hypothenar of the palm. The second edge 132 is opposite a first edge 118.

The glove 100 has a thumb receptacle 112 with a proximal end. 114 and a distal end 116. The proximal end 114 is connected to the first edge 118 of the glove 100. The distal end 116 has a third indicator 120 facing the palmar surface 102.

The indicators discussed in this specification may be surfaces with a relatively high coefficient of friction which will frictionally engage another specified surface. In one such embodiment, the indicators are surfaces that have a different texture (e.g. a higher coefficient of friction) than the remainder of the palmar surface 102. In one embodiment, the indicators are adhesive indicators, such as a hook-and-loop type fasteners such as those sold under the tradename VELCRO®.

Referring to FIG. 2A and FIG. 2B, the dorsal surface 104 of the glove 100 is depicted. The dorsal surface 104 includes a first elongated indicator 134 which is aligned with the thumb receptacle 112. The dorsal surface 104 includes a second elongated indicator 136 which is aligned with index finger receptacle 122. The first elongated indicator 134 and the second elongated indicator 136 meet at a vertex 138. As described in further detail elsewhere in this specification, the first and second elongated indicators 134, 136 function to instruct a wearer of the glove 100 to hold a golf club in various grips. The first and second elongated indicators 134, 136 may be graphic depictions on the surface of glove 100. In one embodiment, the first and second elongated indicators 134, 136 are raised features that may be constructed by, for example, attaching additional material to the glove 100.

In one embodiment, a system is provided that includes both the glove 100 and a golf club handle 300. The handle 300 includes a fourth indicator 302, a fifth indicator 304 and a sixth indicator 306. The fifth indicator 304 is disposed at a terminal end of the handle 300 while the sixth indicator 306 is distal from the terminal end. The fourth indicator 302 is elongated and extends along the longitudinal axis of the handle 300. In one embodiment, the handle 300 is monolithic with regard to a golf club. In another embodiment, the handle 300 is a separate element that attaches to a golf club.

Figure 3:
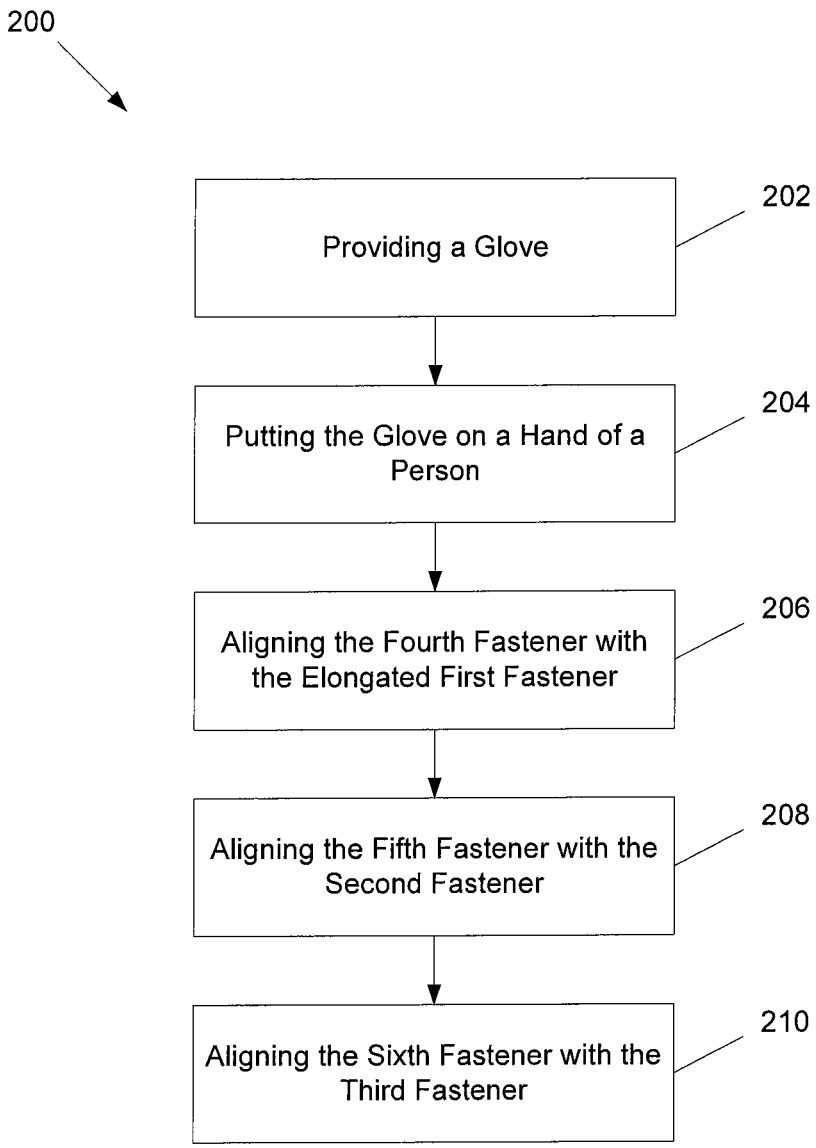
FIG. 3 is a flow diagram of a method of gripping a golf club.
Figure 4:
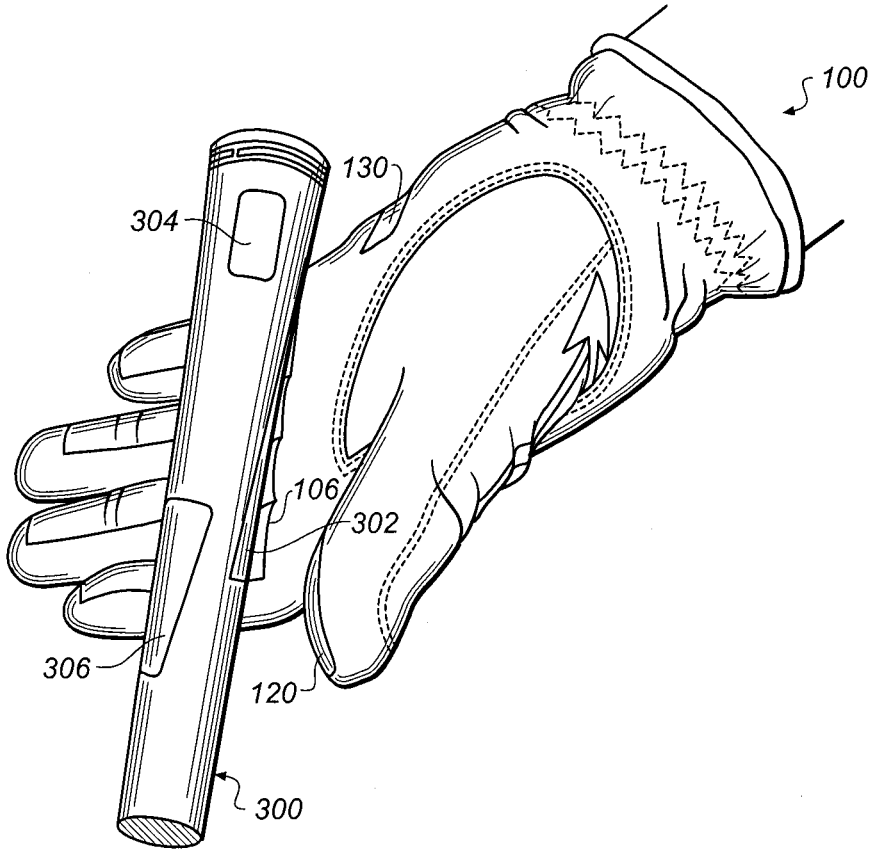
FIG. 4 illustrates the alignment of a fourth indicator with an elongated first indicator.
Figure 5A:
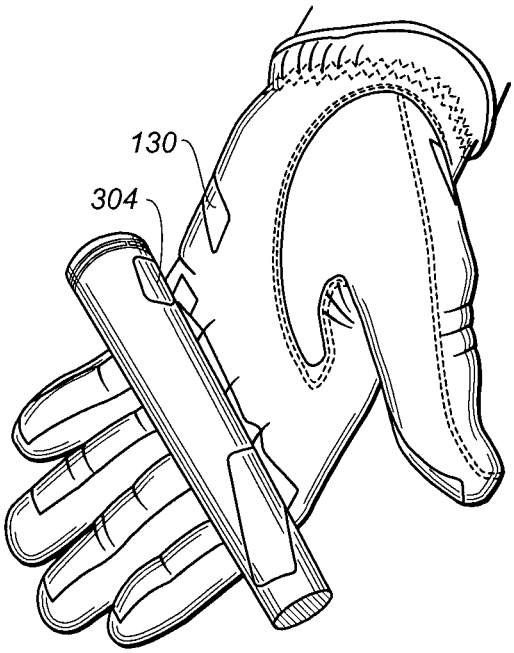
Figure 5B:
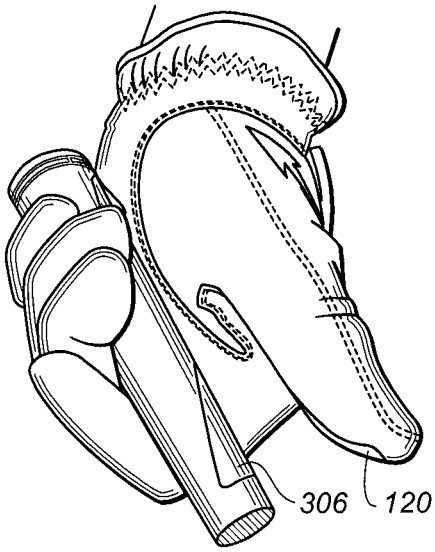
FIG. 5B depicts the alignment of a sixth indicator with a third indicator.
Figure 6A:
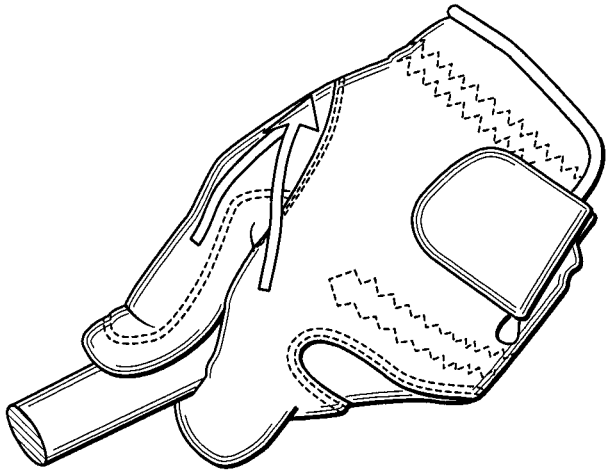
FIG. 6A and FIG. 6B depict a grip after the indicators have been aligned.
Figure 6B:
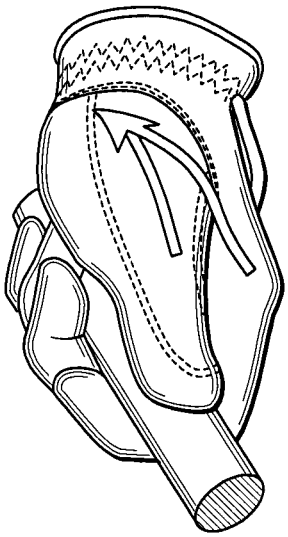

FIG. 3 is a flow diagram of a method 200 for gripping a golf club. The method 200 includes step 202 of providing glove 100. In step 204 a person wears the glove 100. In step 206, depicted in FIG. 4, the fourth indicator 302 is aligned with the elongated first indicator 106. During this step, the face of the golf club is kept square. When the remaining steps are followed while the club is kept square, the wrist angle of the user is properly controlled. This often feels uncomfortable for some users since holding a club properly is unfamiliar. In step 208, shown in FIG. 5A, the fifth indicator 304 to aligned with the second indicator 130. In step 210, shown in FIG. 5B, the sixth indicator 306 is aligned with third indicator 120. FIG. 6A and FIG. 6B depict a grip after the indicators have been aligned.

Figure 7:
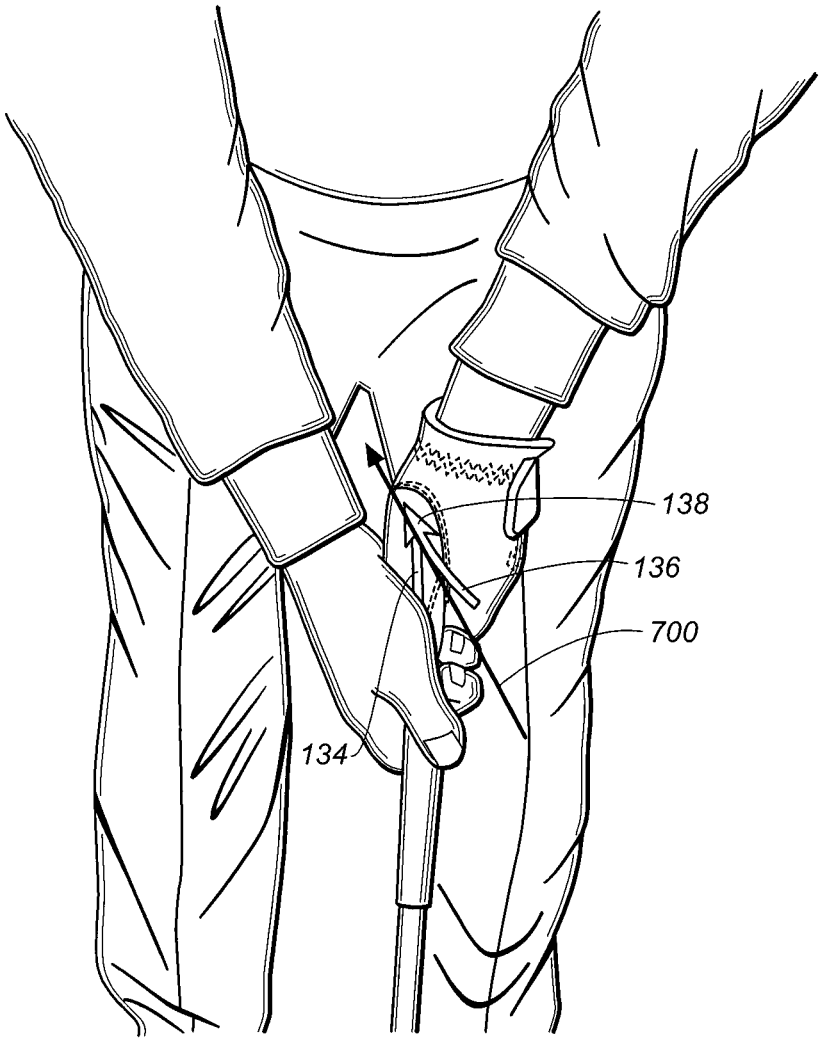
FIG. 7 illustrates a golf club being held with a strong grip.

The first and second elongated indicators 134, 136 and the vertex 138 function as reference points to assist a wearer of the glove to hold a golf club in a variety of different grips; conventionally referred to as a "strong grip," a "semi-strong grip" and a "neutral grip." A shown in FIG. 7, the first and second elongated indicators 134, 136 and the vertex 138 permit the visualization of an imaginary line 700. When the wearer aligns the imaginary line 700 with the wearer's right shoulder, a strong grip is being used. Such a strong grip is illustrated in FIG. 7. When the wearer aligns the imaginary line 700 with the wearer's nose, a neutral grip is being used. When the wearer aligns the imaginary line 700 with the region between the wearer's neck and shoulder, a semi-strong grip is being used.

In one embodiment, the indicators and elongated indicators are color coded so that an instructor may easily reference the elements. For example, both the first indicator 106 and the fourth indicator 302 may be color coded red while the second indicator 130 and the fifth indicator 304 may be color coded blue.

Figure 8A:
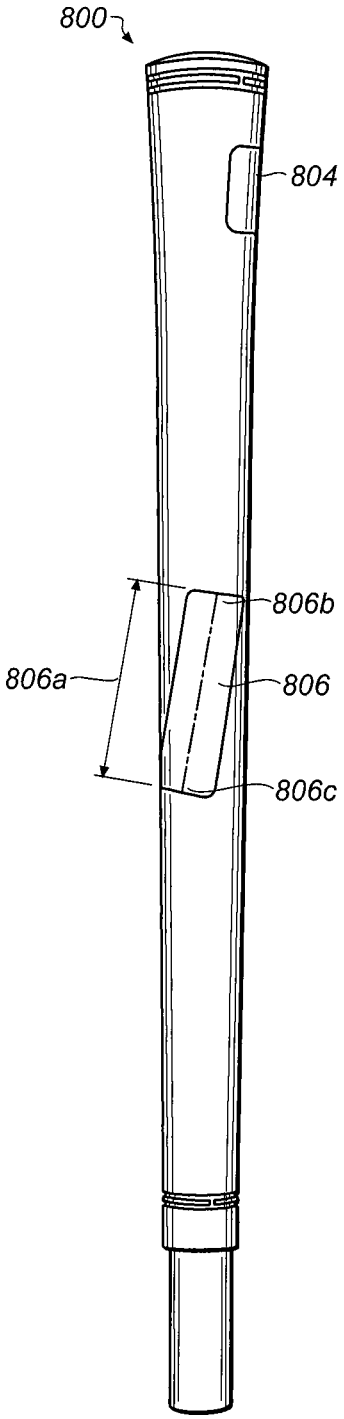
FIG. 8A and FIG. 8B are alternate side views of an exemplary golf club handle.
Figure 8B:
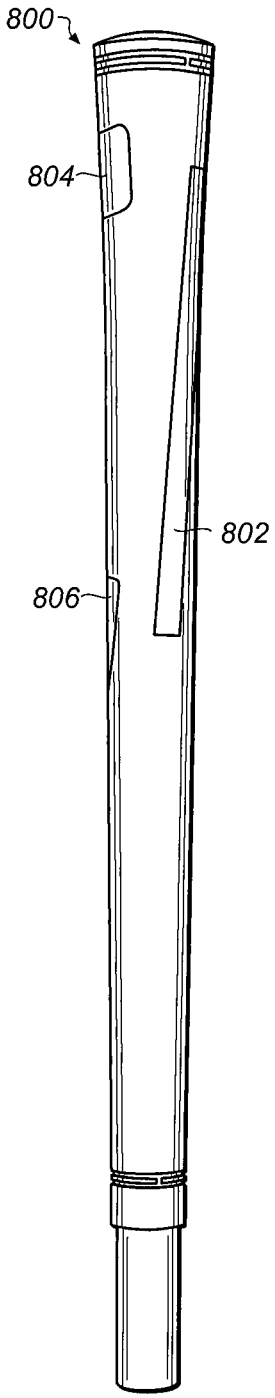

FIGS. 8A and 8B are alternate side views of a golf club handle 800. In the exemplary embodiment, the golf club handle 800 is a insert that fits over a golf club (not shown). The golf club handle 800 comprises a fourth indicator 802, a fifth indicator 804 and a sixth indicator 806, each of which are disposed between the distal end and the terminal end. The fifth indicator 804 is disposed proximate a terminal end of the handle 800 while the sixth indicator 806 is spaced from the terminal end such that the fifth indicator 804 is between the sixth indicator 806 and the terminal end. The fourth indicator 802 is elongated and extends along the longitudinal axis of the handle 800 but is skewed therefrom. In the exemplary embodiment, the sixth indicator 806 is elongated with a width 806*a* that defines a longitudinal axis of the sixth indicator 806. The longitudinal axis of the sixth indicator crosses the longitudinal axis of the golf club due to the sixth indicator being skewed relative to the longitudinal axis. Such an elongated sixth indicator permits a user to adjust one's thumb to a short thumb position 806*b* or a long thumb position 806*c* while still maintaining a proper grip. The skew of the sixth indicator 806 maintains the proper grip.

Figure 9A:
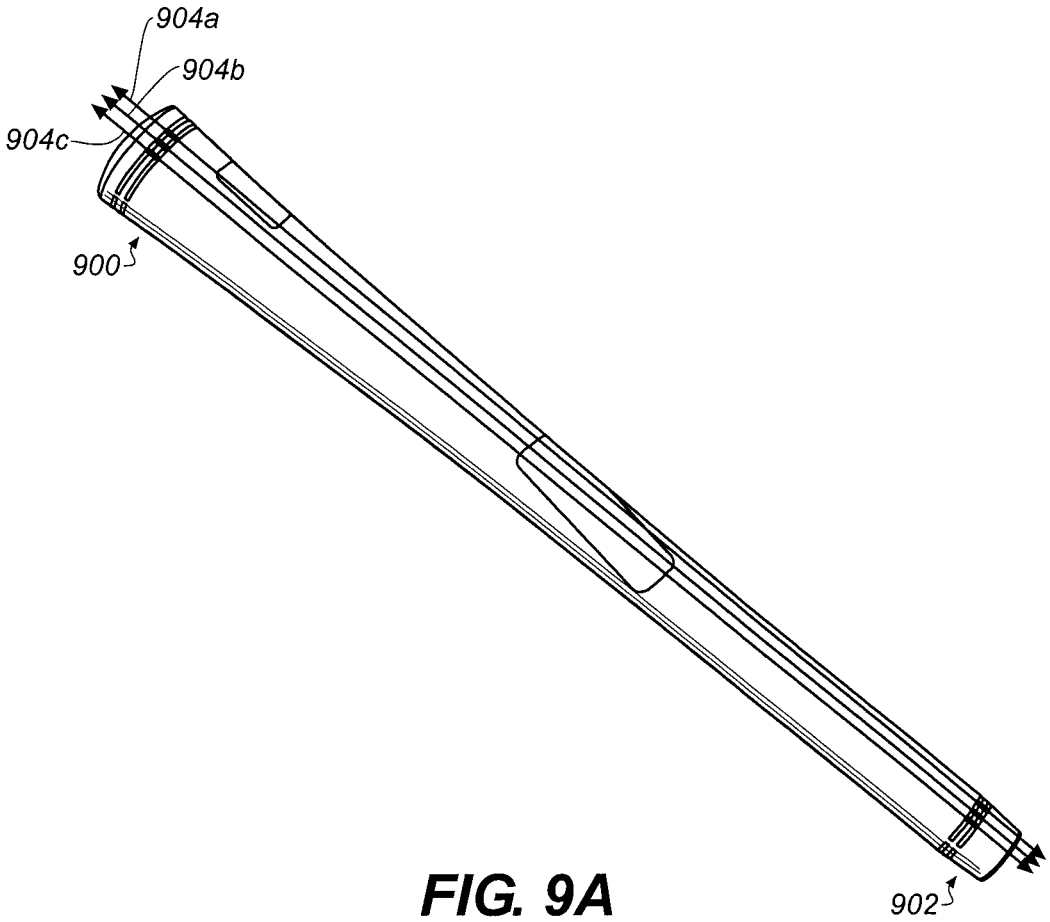
FIG. 9A, FIG. 9B and FIG. 9C depict terminal and distal indicators.

As shown in FIG. 9A, the golf club handle 800 comprises a terminal end 900 which, in turn, comprises first, second and third terminal indicators 900*a*, 900*b* and 900*c*. The golf club handle 800 further comprises a distal end 902 which, in turn, comprises first, second and third distal indicators 902*a*, 902*b* and 902*c*. Terminal indicator 900*a* and distal indicator 902*a* establish a strong-grip line 904*a*. When the wearer aligns the strong-grip line 904*a* with the user's right shoulder, a strong grip is being used. Terminal indicator 900*b* and distal indicator 902*b* establish a semi-strong-grip line 904*b*. When the wearer aligns the semi-strong-grip line 904*b* with the region between the user's neck and shoulder, a semi-strong grip is being used. Terminal indicator 900*c* and distal indicator 902*c* establish a neutral-grip line 904*c*. When the wearer aligns the neutral-grip line 904*c* with the user's nose a neutral grip is being used.

Figure 9B:
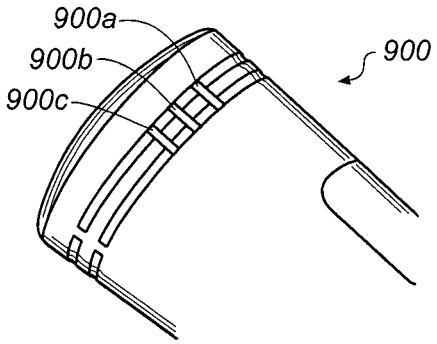
Figure 9C:
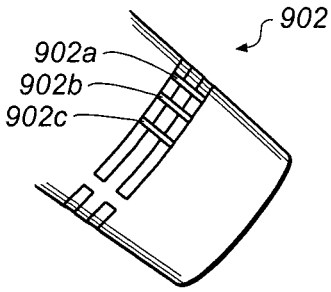

In the exemplary embodiment of FIG. 9A, FIG. 9B and FIG. 9C, terminal indicators 900*a*, 900*b* and 900*c* are parallel white lines that are disposed between, and perpendicular to, two other white lines that at least partially circumscribe the terminal end 900. Likewise, distal indicators 902*a*, 902*b* and 902*c* are parallel white lines that are disposed between, and perpendicular to, two other white lines that at least partially circumscribe the distal end 902.

While the invention has been described with reference to certain embodiments, it will be understood by those skilled in the art that various changes may be made and equivalents may be substituted for elements thereof to adapt to particular situations without departing from the scope of the disclosure. Therefore, it is intended that the claims not be limited to the particular embodiments disclosed, but that the claims will include all embodiments falling within the scope and spirit of the appended claims.

What is claimed is:

1. A method of gripping a golf club comprising the steps of:

providing a golf club handle to a student, the student having a hand comprising a hypothenar region, a base of fingers region and a thumb, the golf club handle comprising:

a terminal end having first, second and third terminal indicators, each parallel one another;

a distal end having first, second and third distal indicators, each parallel one another;

a hypothenar indicator disposed proximate the terminal end;

a thumb indicator, spaced from the hypothenar indicator;

an elongated indicator disposed between the hypothenar indicator and the thumb indicator; wherein:

the first terminal indicator establishes a first line with the first distal indicator;

the second terminal indicator establishes a second line with the second distal indicator;

the third terminal indicator establishes a third line with the third distal indicator;

the first, second and third lines being parallel one another with the second indicator being between the first and third terminal indicator and the second distal indicator being between the first and third distal indicator;

instructing the student to align the base of fingers region with the elongated indicator;

instructing the student to align the hypothenar region with the hypothenar indicator; and instructing the student to align the thumb with the thumb indicator.

2. The method as recited in claim 1, wherein the thumb indicator is elongated, the method further comprising instructing the student to reposition the thumb along the thumb indicator to establish a short thumb position or a long thumb position.

3. The method as recited in claim 1, the method furthering comprising instructing the student to align the first line with the student's right shoulder to establish a strong grip.

4. The method as recited in claim 1, the method furthering comprising instructing the student to align the second line with a the region between the student's neck and shoulder to establish a semi-strong grip.

5. The method as recited in claim 1, the method furthering comprising instructing the student to align the third line with the student's nose to establish a neutral grip.

6. A system for gripping a golf club comprising:

a glove formed of a flexible material comprising:

a palmar surface and a dorsal surface configured to cover a human hand, the palmar surface comprising an elongated first indicator that extends along a width of the palmar surface and is proximate a portion of the glove that is configured to receive fingers;

a second indicator disposed on the palmar surface of the glove along a second edge that is opposite a first edge;

an elongated thumb receptacle with a proximal end and a distal end, the proximal end of the thumb receptacle being connected to the first edge of the flexible material, the distal end of the thumb receptacle having a third indicator facing the palmar surface;

a first elongated indicator aligned with the elongated thumb receptacle facing the dorsal surface;

a second elongated indicator on the dorsal surface, the first and second elongated indictors intersecting at a vertex;

a golf club handle disposed about a golf club, the golf club handle comprising:

a distal end with first, second and third distal indicators, the golf club extending from the distal end;

a terminal end with first, second and third terminal indicators;

wherein the first distal indicator and first terminal indicator establish a first line, the second distal indicator and the second terminal indicator establish a second line and the third distal indicator and the third terminal indicator establish a third line, the first, second and third lines being parallel one another and extending along the longitudinal axis of the golf club; and the golf club handle further comprising an elongated fourth indicator disposed between the distal end and the terminal end, the first elongated indicator having an elongated axis that crosses the longitudinal axis of the golf club, the elongated fourth indicator configured to mate with the elongated first indicator;

a fifth indicator configured to mate with the second indicator;

a sixth indicator configured to mate with the third indicator.

7. A system for gripping a golf club comprising:

an elongated golf club handle with a golf club inserted therein, the golf club having a longitudinal axis and the golf club handle comprising:

a distal end with first, second and third distal indicators, the golf club extending from the distal end;

a terminal end with first, second and third terminal indicators;

wherein the first distal indicator and first terminal indicator establish a first line, the second distal indicator and the second terminal indicator establish a second line and the third distal indicator and the third terminal indicator establish a third line, the first, second and third lines being parallel one another and extending along the longitudinal axis of the golf club; and the golf club handle further comprising a first elongated indicator disposed between the distal end and the terminal end, the first elongated indicator having an elongated axis that crosses the longitudinal axis of the golf club.

8. The system as recited in claim 7, the golf club handle further comprising a palmar indicator between the distal end and the terminal end, the palmar indicator being between the first elongated indicator and the terminal end.

9. The system as recited in claim 8, the golf club handle further comprising a second elongated indicator disposed between the distal end and the terminal end, the elongated indicator having a second elongated axis that crosses the longitudinal axis of the golf club, at least of portion of the second elongated indicator extending between the palmer indicator and the elongated indicator.

* * * * *